United States Patent [19]

Oguchi et al.

[11] Patent Number: 4,647,521

[45] Date of Patent: Mar. 3, 1987

[54] IMAGE-HOLDING MEMBER HAVING TOP LAYER OF HYDROPHOBIC SILICA

[75] Inventors: Yoshihiro Oguchi; Kazuharu Katagiri, both of Yokohama, Japan

[73] Assignee: Canon Kabushiki Kaisha, Tokyo, Japan

[21] Appl. No.: 647,477

[22] Filed: Sep. 5, 1984

[30] Foreign Application Priority Data

| | | | |
|---|---|---|---|
| Sep. 8, 1983 | [JP] | Japan | 58-165468 |
| Sep. 9, 1983 | [JP] | Japan | 58-167070 |
| Sep. 9, 1983 | [JP] | Japan | 58-167074 |
| Jan. 27, 1984 | [JP] | Japan | 59-12084 |

[51] Int. Cl.[4] ..... G03G 5/14

[52] U.S. Cl. ..... 430/58; 430/66; 430/129; 430/39

[58] Field of Search ..... 430/67, 83, 66; 524/531; 430/58, 129, 39

[56] References Cited

U.S. PATENT DOCUMENTS

| | | | |
|---|---|---|---|
| 4,119,460 | 10/1978 | Yoerger | 430/83 |
| 4,195,990 | 4/1980 | Staudenmayer et al. | 430/83 |
| 4,423,131 | 12/1983 | Limburg et al. | 430/67 |
| 4,427,823 | 1/1984 | Inagaki et al. | 524/531 |

*Primary Examiner*—John L. Goodrow

*Attorney, Agent, or Firm*—Fitzpatrick, Cella, Harper & Scinto

[57] ABSTRACT

A photosensitive member, or image-holding member, for electrophotography having a conductive substrate, a top layer for holding electrostatic image and/or toner image wherein the top layer is formed by applying a coating fluid containing hydrophobic silicon and a binder resin, and the display unit used with the photosensitive member.

34 Claims, 12 Drawing Figures

IMAGE-HOLDING MEMBER HAVING TOP LAYER OF HYDROPHOBIC SILICA

BACKGROUND OF THE INVENTION

1. Field of the Invention

The present invention relates to an image-holding member for holding electrostatic images and/or toner images, and more particularly to an image-holding member having improved surface property, abrasion-resistance and durability, and as well as to an electrophotographic photosensitive member having improved sensitivity, durability, surface property, cleanability, toner-filming resistance and abrasion-resistance. Furthermore, the present invention relates to a display apparatus, for displaying, as observable images, electric image information calculated or read out from electronic computers and image-reading-out apparatuses, and similar other image information stored and memorized in magnetic tapes and microfilms in the form of soft copies. It relates also to a display apparatus attached, as image monitors, to image-forming apparatuses, such as copying apparatuses and office automation apparatuses.

2. Description of the Prior Art

Image-holding layers capable of forming electrostatic images and/or toner images, corresponding to the outputs of various information signals on the surfaces of image-holding members, used for electrophotographic copying apparatuses, laser printers, and image-display apparatuses, are already known. These layers may be formed by various processes. The image-holding members forming electrostatic images and/or toner images include image-holding members with photoconductive layers called electrophotographic photosensitive members and image-holding members without photoconductive layers. The image-holding members are usually composed of supports and image-holding layers thereon.

Electrophotographic photosensitive members may have various structures involved in providing them with predetermined characteristics, or according to the applicable type of the electrophotographic process. These members have a structure which is typified by a photosensitive member having its photoconductive layer on a support, and a photosensitive member having further an insulation layer thereon. Some examples in this regard and described in U.S. Pat. No. 2,860,048, Japanese Patent Publication Nos. 16429/1966, 15446/1963 and 3713/1961, U.S. Pat. No. 3,607,258 and Japanese Patent Publication Nos. 23910/1967, 24748/1968, 19747/1967, and 4121/1961. There are photosensitive members having laminated structures of charge generation layers and charge transport layers. The examples are described in Japanese Patent Laid-Open No. 105537/1964, U.S. Pat. No. 3,837,851, Japanese Patent Laid-Open No. 90827/1976, British Pat. No. 1,453,024, U.S. Pat. No. 3,484,237 and U.S. Pat. No. 3,871,882. Some predetermined electrophotographic processes are applied to electrophotographic photosensitive members, to form electrostatic images which are then developed so as to make them distinctly visible.

There is an image display apparatus with a photoconductive layer, using an electrophotographic process (described in British Patent Publication No. 2114772) in which toner images are formed at the same time of exposure.

Image display apparatuses extensively used hitherto include CRT display apparatuses and liquidcrystal display apparatuses, which are not always satisfactory in respect of resolution, the area of the display image, and observability. Recent progress in office automation apparatuses has required displays with very fine, stationary images for monitors of word processors, microfilm retrieval devices and optical disk memories. In view of this progress, images on the CRT and liquid crystal display apparatuses cannot be regarded as uptodate and adequate because of the screen flicker and dependance on visual angle.

As methods of solving the problems of the CRT and liquid crystal display apparatuses, there may be exemplified a method for forming a toner image at the same time of exposure, using a photoconductive layer as the aforementioned image-holding member (British Patent Publication No. 2114772), a method for giving an electrostatic charge image on the dielectric belt of an image-holding member by means of stylus electrodes to convert the images into a toner image (Japanese Utility Model Laid-Open No. 55061/1982), and a method for forming a latent image on a magnetic recording layer to visualize it on the surface of an image-holding member by use of a toner in the form of magnetic powder or fluid according to the magnetizable signals.

The fact that these display images are superior to those in the conventional electrophotography, electrostatic printing and magnetic printing will be easily understood, since any image transfer process is not involved. The images can be especially excellent for stationary image displays, because the quality of the images is as clear as prints, specially in contrast to the images of the aforementioned universal CRT and liquid crystal display apparatuses.

The problem of a display apparatus exclusively meant for toner images is one of marked contamination of the non-image portions due to qradual adherence of toners and coloring materials for toners on the surfaces of image displays because of the repeated use of the same image-holding member. The displaying process by this method comprises conversion of an information signal into time-series signals, such as light, e.g. laser beams, voltages, and currents in order to form a latent image on the image-holding member, followed by development of the image by means of a toner. Repeated display operations are carried out by erasing the image, which has become unnecessary, and producing another image pattern on the surface of the same image-holding member by the same process once again. Accordingly, contamination on the surface of the image-holding member causes a markedly deterioration in the quality of the image. This problem has presented a serious problem in making this type of display apparatus practical. A method for obtaining an image by a similar process involves the use of an apparatus for giving a print image by transferring on commonly used paper a toner image formed on intermediate masters, as in the aforementioned electrophotographic copying, electrostatic printing, and magnetic printing. The intermediate masters which are repeatedly used in the printing apparatuses, even if contamination on the surfaces of the masters themselves causes no adverse effect on the transferred images, present no problem concerning their practical use. However, on the other hand, if the toner image on the master is used as a display image, the eventuality of contamination will seriously jeopardise the quality of the display.

Image-holding members for the aforementioned image display apparatus require not only suitable physical and electrical characteristics, but also durability and cleanability. Durability is required when the image-holding member is repeatedly used. Cleanability is a requirement for determining the possibility or otherwise of easy removal of a toner adhering to and remaining on the surface of the image-holding member. It greatly affects formation of clear images and prevention of damage to the cleaning mechanism.

Conventional image-holding members have disadvantages, such as unsatisfactory surface smoothness and abrasion resistance, and the presence of background stains due to insufficient cleaning when repeatedly used.

As stated earlier, the electrophotographic photosensitive members have various structures for giving them desired characteristics, or according to the type of the electrophotographic process. The members are exemplified by a photosensitive member having a photoconductive layer formed on a support, and a photosensitive member which has further an insulation layer on the surface thereof. Further, there is another photosensitive member which has a laminated structure in which the photoconductive layer consists of a charge generation layer and a charge transport layer.

Such electrophotographic photosensitive members require not only the electrical characteristics suitable for the electrophotographic process comprising charging, imagewise exposure, development, transfer, cleaning, and removal of charge simultaneous with exposure, but also durability and cleanability. Durability is required when a photosensitive member is repeatedly used. Cleanability is a requirement for determining the easiness of removal of toners adhering to or remaining on the surface on the photosensitive member and greatly affects formation of clear images and prevention of damage to the cleaning mechanism.

In the conventional electrophotographic photosensitive members, the insulating layers for the photoconductive layers are formed from coatings, such as of acrylic or styrene resins. When the photoconductive layer is of laminated structure consisting of a charge generation layer and a charge transport layer, the latter one, beinq the surface layer, uses a styrene resin, or an acrylic resin, or a cellulose resin as the binder for a hydrazone compound or a pyrazoline compound, and these resins constitute the coatings.

Electrophotographic photosensitive members having surface layers using such coatings have unsatisfactory surface hardness and abrasion-resistance, and therefore stains on the background of copy images become increasingly apparent due to insufficient cleaning by any repeated electrophotographic process. Low hardness of the surface layer of the electrophotographic photosensitive member, which comes into contact with the blade of a urethane rubber used in the cleaning process, further decreases the cleanability.

The electrophotographic photosensitive member is basically composed of a substrate and a photosensitive layer. If desired, a subbing layer may be placed between the substrate and the photosensitive layer for the purpose of improving adhesion between the substrate and the photosensitive layer, enhancing the coating property of the photosensitive layer, protecting the substrate, coating the defects on the substrate, protecting the photosensitive layer from any electrical destruction, and improving injection of charges from the substrate to the photosensitive layer.

The subbing layer may be composed of polyvinyl alcohol, polyvinyl methylether, poly-N-vinylimidazole, polyethylene oxide, ethylcellulose, methylcellulose, ethyleneacrylic acid copolymer, casein, polyamides, glue and gelatin. The film thickness is in the order of 1–10 $\mu$ (microns).

Formation of a subbing layer can be an effective means, but it has various disadvantages, such as difficult obtainability of satisfactory raw material, increase in the manufacturing costs because of the many coating processes involved, and the increased items of production control, resulting in the increased costs.

Although the photosensitive layer of the laminated structure generally consists of a charge generation layer and a charge transport layer, both layers are electrically connected to each other, and the charge carrier generated in the charge generation layer, in the presence of an electric field is to be efficiently injected to the charge transport layer.

For this reason, we have conducted various investigations for better charge injection by means of improvement in adhesion or close contact between the charge generation layer and the charge transport layer.

SUMMARY OF THE INVENTION

It is an object of the present invention to provide a novel image-holding member and an electrophotographic photosensitive member, which eliminates the above-noted disadvantages.

It is another object of the present invention to provide an image-holding member and an electrophotographic photosensitive member having improved surface property, cleanability and abrasion-resistance.

It is a further object of the present invention to provide an image-holding member used in an apparatus adapted to display high-quality, stationary images, particularly an image-holding member used in such image-display apparatus, having an improved contamination-resistance property on the surface.

It is still another object of the present invention to provide an electrophotographic photosensitive member having improved adhesiveness and charge injection properties between the charge generation layer and the respective adjoining layers.

The above-noted objects of the present invention are accomplished by an image-holding member, or an electro photographic photosensitive member containing hydrophobic silica, especially organic solvent-dispersed silica.

According to an aspect of the present invention, there is provided an image holding member comprising a conductive substrate and a top layer capable of holding electrostatic images and/or toner images, characterized in that a top layer is formed by coating a coating liquid containing a hydrophobic silica and a binder resin.

According to another aspect of the present invention, there is provided a photosensitive member for electrophotography having a conductive substrate, a charge generation layer and a charge transport layer in a laminate structure characterized in that the charge generation layer is formed by applying a coating liquid containing an organic solvent-dispersing silica.

According to a further aspect of the present invention, there is provided an image holding member having a substrate, a magnetic record layer and a top layer characterized in that the top layer is formed by applying a coating liquid contaning a hydrophobic silica and a binder resin.

According to still another aspect of the present invention, there is provided a display unit, housing an image holding member which is used in repetitions for image display, the image display being effected by forming toner images corresponding to the information in signals directly on the surface of the image holding member, wherein the toner-image-forming top layer of the image holding member is formed by applying a coating liquid containing an organic-solvent-dispersing type silica and a resin.

DETAILED DESCRIPTION OF THE PREFERRED EMBODIMENTS

The characteristics and effectiveness of the image-holding member in the present invention are detailed below.

Figure 1:
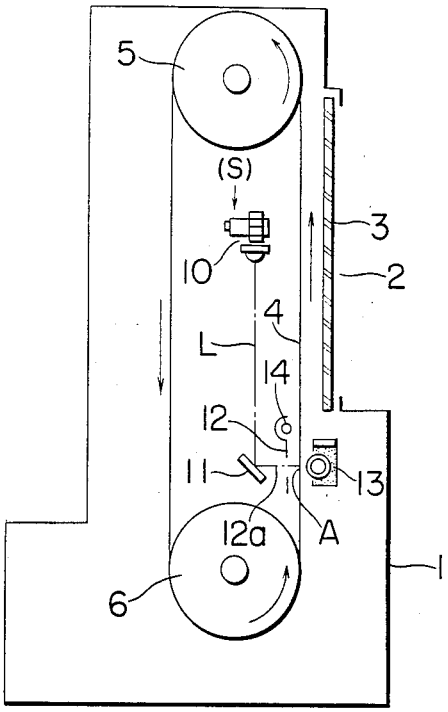
FIG. 1 illustrates a schematic configuation of an example of the display apparatus.

An image-holding member using a photoconductive layer is shown in FIG. 1, as an example of image display apparatus using toner images.

Figure 2:
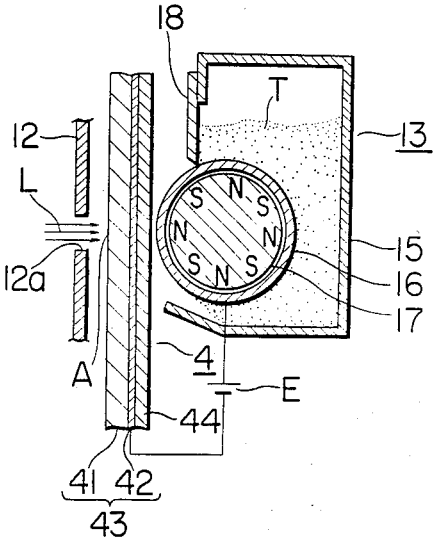
FIG. 2 is a enlarged sectional view of a part of the development apparatus.

FIG. 1 is a vertical sectional view showing a schematic structure of an example of an image display apparatus as mentioned above, in which numeral 1 is the vertical housing of the apparatus, and 2 is a display window widely opened within the front panel of the housing, in which a transparent panel 3, such as glass plate is placed. An endless belt-type, photosensitive member 4 (an image carrier, which will be abbreviated as "belt") is positioned between a driving pulley (or a driving roller) 3 and a follower (or a roller) 6 which are placed in parallel to the top and the bottom of the housing. The belt 4 is produced, as shown in FIG. 2, in such a manner that a transparent electroconductive layer 42 is formed by thin vapor deposition of a metal, or a metal oxide, such as indium oxide, tin oxide, or chromium oxide on the outside surface of a transparent, flexible, and tough base sheet material 41, such as a synthetic resin sheet or a film, and a photoconductive layer 44 is formed further on the electroconductive layer 42 by the coating method or vapor deposition method. The base sheet 41 and the conductive layer 42 constitute a transparent electroconductive substrate layer 43. The outer circumference surface of the belt 4 is the surface of the photoconductive layer. The belt 4 is rotatively driven in the direction marked by an arrow rotation of the driving pulley 5, and the external tension side of the belt 4 travels from the lower side to the upper side of the display window 2.

An optical image exposure apparatus 10 of the light beam scanning system is placed in the space between the tension side and the loose side of the rotary belt, the apparatus being composed of a semiconductor laser (or a gas laser), a polygonal mirror, and an f-$\theta$ lens. In the apparatus, the output of time series electrical digital signal of image element (S) are drawn from an image-reading-out apparatus and an electronic computer (omitted in the drawing) to oscillate the laser beams (L), modulated according to the signal, in the direction of the follower pulley 6. The oscillated beams are biased toward the back side portion (A) of the tension side of the belt 4 in the neighborhood of the follower pulley 6 by a mirror 11, and said back side portion A is scanned and exposed in the direction of the belt width, through a slit 12*a* of a slit plate 12. The optical image exposure is successively performed toward the back side of the belt 4, while making the scanning in the direction of the belt-width of the laser beam (L) the major scanning function and that of the onward movement of the belt 4 the minor scanning function.

A developing apparatus 13 is arranged at the position near the frontsurface of the belt 4, corresponding to the back side portion A of the belt 4 subjected to the laser-beam-scanning-exposure, and a whole surface-light-illuminating lamp 14 is arranged on the back side of the tension side of the belt 4 and at a position ahead of the exposure portion (A) relative to the travelling direction of said belt.

The developing apparatus 13, as shown in FIG. 2, comprises a developer-containing chamber 15, a non-magnetic rotary development sleeve 16, made of stainless steel or aluminum, which is horizontally placed in the chamber and whose substantial left portion, equivalent to its semi-circumferential surface, is projected towards the outside of the chamber, a magnetic roller 17, built into the sleeve 16, a developer-coating blade 18, placed outside the sleeve 16, and a developer T (electroconductive magnetic toner) contained in the chamber 15. The electroconductive magnetic toner T near said rotary development sleeve 26 is attracted by the magnetic field of the magnetic roller 17 in the sleeve 16, and then held on the outer periphery of the sleeve 16 as a magnetism-absorbing layer, and further carried by rotation of the sleeve 16. The thickness of the toner layer is controlled by the blade 18 which makes it an ordered layer. The surface of the toner layer contacts and passes through the surface of the belt 4 corresponding to the optical image exposure portion (A) of the back side of the belt with th pivotal rotation of said sleeve.

A direct curent bias is applied between the electroconductive layer 42 on the belt 4 and the development sleeve 16, and E represents the power source.

Images are displayed by the following mechanism: when the belt 4 and the development apparatus 13 are driven and light 7 image exposure is carried out on the exposure portion (A) at the back side of the belt 4, the electroconductive toner on the development sleeve 16 selectively adheres to the surface of the belt 4 according to the principle to be described later to form a toner image that conforms to the exposed image. The surface of the belt on which the toner image is produced pivotally rotates and moves toward the window 2, and stops within the region of the window 2 for a while, and as a result the first image is displayed on the window 2. After a predetermined time has passed or a button for re-starting the belt has been pressed, the belt pivotally rotates again, and the image to be next displayed moves to the window 2, and then the belt stops for a while to allow the image to be displayed on the window. The repeated operation is meant to display the images successively.

Pivotal rotation of the belt after completion of the image display, removes the already displayed toner image from the surface of the belt by the developing and cleaning function of the development apparatus 13 when the image reaches again the development apparatus 13, and as a result, the toner is recovered by the apparatus. The toner images, corresponding to optical image exposure patterns on the exposure portion (A), are successively formed on the belt surface from which old toner images have been removed, and the newly formed other images are transferred to the window 2 with the pivotable rotation of the belt 4.

The whole surface, light-illuminating lamp 14 is so arranged as to make the electrical conditions in the photoconductive layer 44 of the belt 4 uniform by uniformly illuminating the back surface side of the belt, in the direction of the width, on the front surface of which toner images are produced at the light image exposure portion (A).

The toner images on the surface of the belt are produced simultaneously with the light image exposure without the charging step. The principle is described with reference to FIGS. 3 and 4. For further explanation, it may be added that the photoconductive layer 44 of the belt 4 may be regarded as N-type, the electroconductive layer 42 as negatively charged, and a positive bias as applied to the developing sleeve 16.

Figure 3:
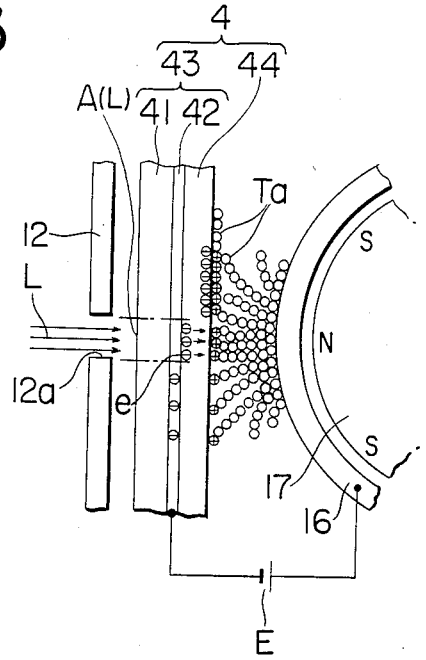
FIG. 3 is a schematic diagram of the image-forming principle in the light portion of an exposure.

Light on the light portion of exposure [A(L) in FIG. 3] in the light image exposure portion A on the back surface of the belt is transmitted into the transparent substrate layer 43 and then becomes incident on the photoconductive layer 44. In a portion of the layer 44 receiving the incident light, pairs of electrons-positive holes are generated. Among them, electrons e are attracted by the positive bias on the development sleeve, and then these travel toward the surface side of the photoconductive layer 44. Subsequently, positive charges, as opposed to the negative charge of the electrons e, are induced on the electroconductive toner on the surface of the toner layer on the sleeve 16, which contacts and passes through the belt surface corresponding to the light image exposure portion A(L) at the back side of the belt. The positive charges-inducing toner adheres to the belt surface from the sleeve 16, by means of the Coulomb force between the electrons e and the positive charges. The positive charges of the adhered toner (Ta) are dissipated within a short period of time by its neutralization with the electrons e travelling at the surface of the photoconductive layer 44.

Figure 4:
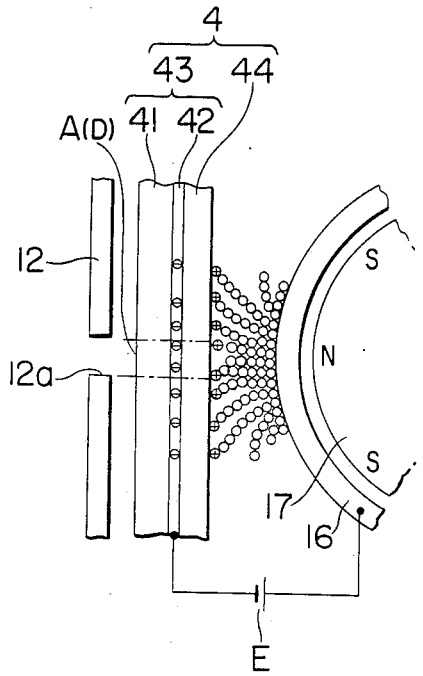
FIG. 4 is a schematic diagram of the image-forming principle in the dark portion of an exposure.

On the other hand, in the dark portion of exposure [A(D) in FIG. 4] in the light image exposure portion A, although a bias between the electroconductive layer 42 of the belt 4 and the developing sleeve 16, and a capacitance between the layer 42 and the electroconductive toner layer on the side of sleeve 16 will induce both positive and negative charges on the electroconductive layer and the toner on the surface layer of the electroconductive toner layer, respectively, the Coulomb force between the charges is weak and, as such, very little adherence of the toner occurs on the surface of the belt 4.

Accordingly, the toner Ta selectively adheres only to the surface of the photoconductive layer 44, corresponding to the light portion of the light image exposure, simultaneously with the light image exposure, without the charging treatment on the photoconductive layer 44 of the belt 4, thereby forming a toner image.

The toner image rotated to reach the developing apparatus 13 after the display is over can easily be removed from the surface of the belt by rubbing with the toner layer held on the developing sleeve 16. The toner of the image is recovered into the toner layer on the sleeve and is repeatedly used for the formation of toner images.

The image display system in which the images are produced as toner images on the surface of an image-holding member using a photoconductor, has many advantages, including, for example, a better resolution than that of a CRT display apparatus and a liquid crystal display apparatus. The display images can easily be observed and cause no eye fatigue because of non-flickering, stationary images and little angle-dependence like that of liquid crystal displays, and, if necessary, also can easily be made hard copies by adding to the apparatus a mechanism for transferring a toner image produced on the surface of the belt onto copying papers. The above-noted non-charging system of the apparatus, which produces toner images simultaneously with exposure, and which serves both development and cleaning, has a very simple structure and is very practical.

As the light image exposure apparatus 10, there may be used LED array apparatus, liquid crystal shutter array apparatus, PLZT, and various shutter array apparatuses which selectively transmits white light, in addition to the apparatus employing the above-noted laser beam scanning system. An exposure apparatus utilizing X-rays may be used. In this case, the substrate layer 43 of the belt 4 may be X-ray transmissive, and not visible-light-transmissive. The image-holding member in the present invention may be produced, either by forming a surface layer (not shown)on the aforementioned photoconductive layer 44, or by laminating an intermediate layer (not shown) and a surface layer, in this sequence, on the photoconductive layer 44. The intermediate layer may be formed from a polyamide, polyvinyl alcohol, casein, an ionomer resin, and ethylene-acrylic acid copolymer. Titanium oxide and zinc oxide may be contained therein. The surface. layer may be formed by coating on the photoconductive layer 44, or on the intermediate layer, a coating liquid of a white pigment such as titanium oxide, zinc oxide, or tin oxide, or an appropriate white dyestuff, and the above-noted silica powder contained in an appropriate binder resin. The binder resins of the surface layers are exemplified by polymethyl mathacrylate resins, polystyrene resins, phenolic resins, polyamide resins, alkyd modified silicon resins, acrylic modified silicon resins, polyester resins, polyarylate resins, polycarbonate resins, and polyvinyl butyral resins.

The present invention relates to improvement in the contamination resistant property of the image-holding member used for the above-mentioned image display apparatus. Contamination may be reduced by an integrated technique concerning the toner as a contamination - producing factor, the surface of image-holding member, and image forming and erasing processes. As a result of investigation, particularly on the surface layer of the image-holding member, an organic solvent-dispersed silica, contained in the surface layer, was found to have remarkably reduced the degree of contamination.

Hitherto used colloidal silica involve aqueous sols using water as a dispersion medium and aerosols using air as a dispersion medium. The former, usually called silica. sol, heretofore is known to involve one in which numerous particles of diameters ranging from several tens Å to several hundreds Å, are dispersed in water and stabilized, and specially in hydrophilic solvents miscible well with water such as methanol and ethanol. These water-dispersed silica sols have disadvantages such as limited selection of resins and high hygroscopicity. The existing aerosols involve white carbon and aerosil.

These colloidal silica have low density because of agglomerated particles with gaps. When they are added to an organic solvent, the solvent fills the gaps, resulting in an increased viscosity and occurrence of thixotropy or sedimentation of the silica. The colloidal silica have agglomerated particles and are distinguishable from silica sol used in the present invention with the individual silica particles of a colloidal nature.

Silica powder used in the conventional image-holding member uses water as a dispersion medium, and has its numerous particles dispersed and stabilized in water. Further, there are silica particles dispersed in hydrophilic organic solvents, well-miscible with water, such as methanol or ethanol. These water-dispersed silica powders have problems in view of their limited selection of resins and their hygroscopicity.

The hydrophobic silica powder used in the present invention may be dispersed in hydrophobic organic solvents by applying the hydrophobic treatment to the surface of the silica particles, for example, in such a manner that an organic silicon halide or an alcohol is substituted for the silanol group of the water-dispersed silica particles. Such silica powder can be colloidally dispersed and stabilized in solvents because of its primary particle sizes, which are very fine, from 10 Å to 1000 Å, preferably from 10 Å to 500 Å, and because the surface area per unit weight is very large, from $10m^2/g$ to $1000m^2/g$, preferably from $10m^2/g$ to $500m^2/g$. Evaporation of the solvent from the dispersed liquid causes the colloidal silica to firmly adhere to the rugged portions of a material, and provides it with good adhesiveness. Mixing, dispersing, and coating of a hydrophobic silica powder with a resin in an organic solvent gives it surface smoothness and an increased adhesion capability after drying.

Silica used in the present invention is produced by applying the hydrophobic treatment to the surface of colloidal silica, and may be dispersed in hydrophobic solvents such as toluene and benzene.

Hydrophobic silica powders in this type, commercially available, are Aerosil R-972 (Nippon Aerosil Corporation), OSCAP (powder) (Shokubai Kasei Kogyo Corporation), OSCAL (organic solvent-dispersed) (Shokubai Kasei Kogyo Corporation) and white Carbon. The use of powder, hydrophobic silica, such as OSCAP, is preferred in the present invention.

Mixing, dispersing and coating of silica with a resin in an organic solvent, as in the present invention bring about chemical reactions such as hydration and esterification on drying, resulting in newly strengthened bonds, higher surface hardness, and an increased abrasion-resistance and durability.

The organic solvents for the dispersing media of the organic solvent-dispersed silica are exemplified by methanol, ethanol, n-propanol, iso-propanol, n-butanol, t-butanol, pentanol, ethylene glycol, glycerin, ethyl cellulose, dimethylformamide, toluene, tetrahydrofuran, acetone, benzene, and xylene. Accordingly, the coating solution may be prepared by selecting a binder resin to be used for the surface of the image-holding member, and dissolving it in the afore-mentioned dispersion liquid.

The hydrophobic silica powder used in the present invention to be contained in the surface layer, forming electrostatic images and/or toner images, markedly improves the surface smoothness, cleanability, abrasion-resistance, and adhesiveness of the surface layer to the lower one. This constitutes the major feature of the image-holding member of the present invention. Another feature of the image-holding member of the present invention is that it contains the above-noted organic solvents-dispersed silica in the surface layer.

The present invention is to be described with reference to an embodiment thereof shown in the drawings.

When the image-holding member is an electrophotographic photosensitive member, it comprises an electroconductive substrate and a photoconductive layer, and an optional protective layer.

Figure 5A:
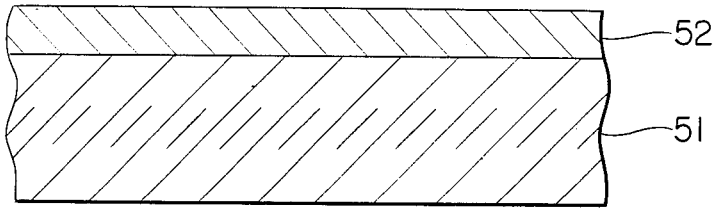
FIGS. 5(A), 5(B) and 5(C) are the cross-sectional views of the image-holding members of the present invention.
Figure 5B:
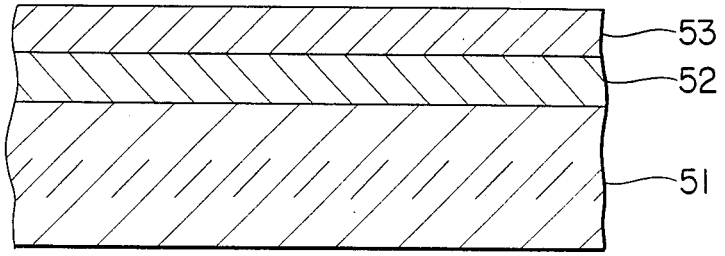

In the preferred embodiment of the present invention, as shown in FIGS. 5A and 5B, the electrophotographic photosensitive member may be composed of an electroconductive substrate 51 and a photoconductive layer 52 thereon. The photoconductive layer contains hydrophobic silic and organic photoconductive substances such as pyrylium dyes or the cocrystalline complexes thereof, thiapyrylium dyes or the cocrystalline complexes thereof, cyanine dyes, phthalocyanine pigments, anthanthrone pigments, dibenzopyrene quinone pigments, pyranthrone pigments, trisazo pigments, disazo pigments, azo pigments, indigo dyes, quinacridone pigments, asymmetric quinocyanine pigments, and quinocyanine pigments; or inorganic photoconductive substances such as zinc oxide, cadmium sulfide and selenium; together with the binders.

In another embodiment of the present invention, as shown in FIG. 5B, a film containing the abovenoted hydrophobic silica in a binder may be used as the protective layer 53 for the photoconductive layer 52 containing a photoconductive substance in a binder.

Binder resins used in the photoconductive layer 52 and the protective layer 53 used in the electrophotographic photosensitive member shown in FIGS. 5A and 5B may include insulating resins such as acrylic resins, polyacrylates, polyesters, polycarbonates, polystyrene, acrylonitrile-styrene copolymer, acrylonitrile-butadiene copolymer, polyvinyl butyral, polyvinyl formal, polysulfone, polyacrylamides, polyamides, and chlorinated rubber; and poly-N-vinylcarbazol, polyvinyl anthracene, or polyvinyl pyrene may be further contained in adequate proportion. The proportions of the abovementioned silica to the binder resin is 1–200 parts by weight, preferably 1–150 parts by weight, more preferably 10–50 parts by weight, per 100 parts by weight of the binder resin. The dispersion may be accomplished by usual methods such as the use of a homogenizer and ball mills.

In this embodiment, a photoconductive layer 52 containing a hydrophobic silica powder may be formed on an electroconductive substrate 51, and alternatively, a protective layer 53 containing a hydrophobic silica powder may be formed on a photoconductive layer 52. The protective layer 53, as clarified in the following examples, preferably contains white pigment such as $TiO_2$. In this case, toner images are formed on the white protective layer 53, and as a result, it is displayed in the white background, which is desirable from the standpoint of human-factors engineering.

Figure 6A:
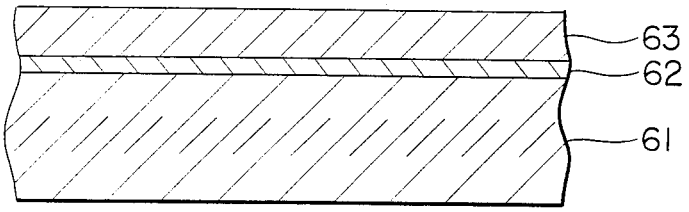
FIGS. 6(A), 6(B), 6(C), 6(D) and 6(E) are the cross-sectional views of the electrophotographic photosensitive members of the present invention.
Figure 6B:
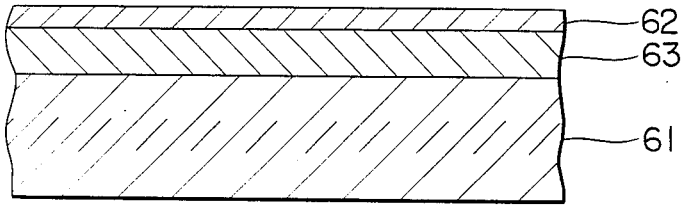
Figure 6C:
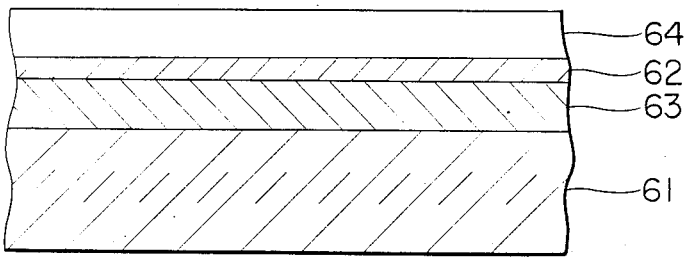

The photoconductive layer 52, as shown in FIGS. 6A–6C may be formed so as to have a laminated structure which is functionally separated into a charge generation layer and a charge transport layer.

In the embodiment shown in FIG. 6A, an electrophotographic photosensitive member comprises a charge generation layer 62 on an electroconductive substrate 61 and a charge transport layer 63 as a surface layer on the charge generation layer 62. The charge generation layer 62 is preferably formed so as to contain the above mentioned photoconductive substance in an amount as much as possible for obtaining sufficient light-absorbability and have a thin film thickness for shortening the travelling distance of the generated charge carrier. For example, its film thickness can be 5 microns or less, and preferably from 0.01 to 1 micron. This fact is attributable to the generation of many charge carriers because of the absorption of a greater part of the quantity of the incidental light in the charge generation layer 62, and to the need for the injection of the generated charge carriers into the charge transport layer 63 without deactivation because of recombination and trap of the carriers.

The charge generation layer 62 may be formed by dispersing a photoconductive substance (to be described later on) into an appropriate binder and then coating the dispersion on the substrate 61. Alternatively, it may be formed as a film deposited by a vacuum deposition apparatus. The binder used in forming the charge generation layer by coating may be selected from a wide variety of insulation materials, and from organic photoconductive polymers, such as poly-N-vinyl carbazole, polyvinyl anthracene and polyvinyl pyrene. As preferable materials, there may be mentioned insulating resins such as polyvinyl butyral, polyarylates, polycarbonates, polyesters, phenoxy resins, polyvinyl acetate, acrylic resins, polyacrylamide resins, polyamides, polyvinyl pyridine, cellulose resins, urethane resins, epoxy resins, casein, polyvinyl alcohol, and polyvinyl pyrrolidone. The suitable percentage of resins in the charge generation layer 62 is 80 percent by weight or less, and preferably 40 percent by weight or less. The solvents for dissolving these resins may vary depending upon the kind of the resin. These are preferably selected from many solvents, which do not cause dissolution of the charge transport layer and the underlying layer (omitted from the drawings). Examples of these organic solvents are: Alcohols such as methanol, ethanol and isopropanol; ketones such as acetone, methyl ethyl ketone and cyclohexanone; amides such as N,N-dimethylformamide and N,N-dimethylacetamide; sulfoxides such as dimethylsulfoxide; ethers such as tetrahydrofuran, dioxane, and ethylene glycol monomethyl ether; esters such as methyl acetate and ethyl acetate; aliphatic halogenated hydrocarbons such as chloroform, methylene chloride, dichloroethylene, carbon tetrachloride and trichloroethylene; and aromatic hydrocarbons such as benzene, toluene, xylene, ligroin, monochlorobenzene and dichlorobenzene.

The coating may be carried out by immersion-coating, spray-coating, spinner-coating, bead-coating, Myer Bar coating, blade-coating, roller-coating, or curtain-coating. Drying may be conducted preferably by heating after set to touch at room temperature. Heat-drying may be carried out under stationary conditions, or by controlled blowing of hot air, at a temperature ranging from 30° C. to 200° C., and for a period from 5 min. to 2 hr.

The charge generation layer 62 may be formed by super imposing on the electroconductive substrate 61 an amorphous silicon film, a copper-phthalocyanine-deposited film, a selenium-tellurium-deposited film, a perylene-pigment-deposited film, or a methine squaric acid dye-deposited film. Alternatively, it may be formed by providing on the electroconductive substrate 61 a coating layer formed by dispersing, in a binder, azo pigments such as disazo and trisazo pigments, phthalocyanine pigments such as copper phthalocyanine, aluminum chloride phthalocyanine, vanadium phthalocyanine and metal-free phthalocyanine, pyrylium dyes or the cocrystalline complexes thereof, and thiapyrylium dyes or the cocrystalline complexes thereof.

Furthermore, photoconductive substance contained in the charge generation layer 62 may be selected from various substances, such as pyrylium dyes, thiapyrylium dyes, cyanine dyes, phthalocyanine pigments, anthanthrone pigments, dibenzopyrene quinone pigments, pyranthrone pigments, trisazo pigments, disazo pigments, azo pigments, indigo dyes, quinacridone pigments, asymmetric quinocyanine, quinocyanine pigments, zinc oxide and cadmium sulfide. The following photoconductive substances are definitely suitable in this regard:

Charge generation substances:

Disazo pigments such as

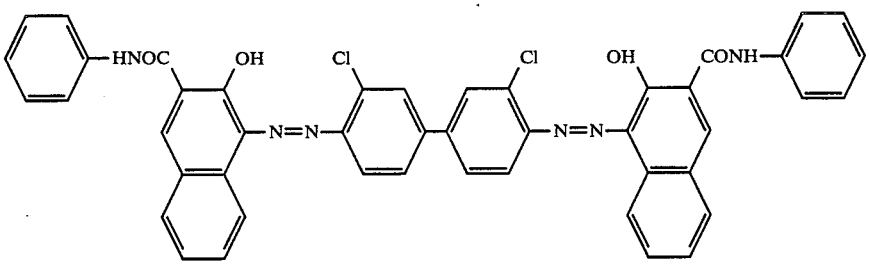

(1)

-continued
(2)
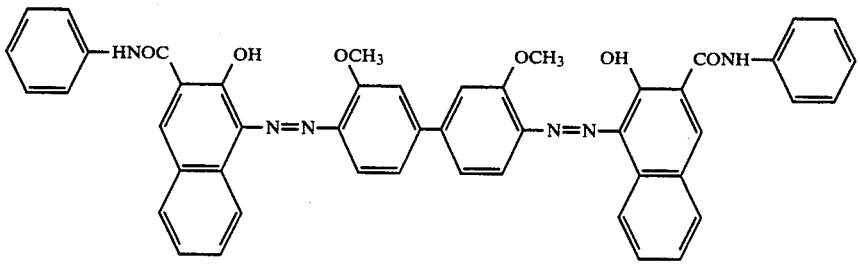
(3)
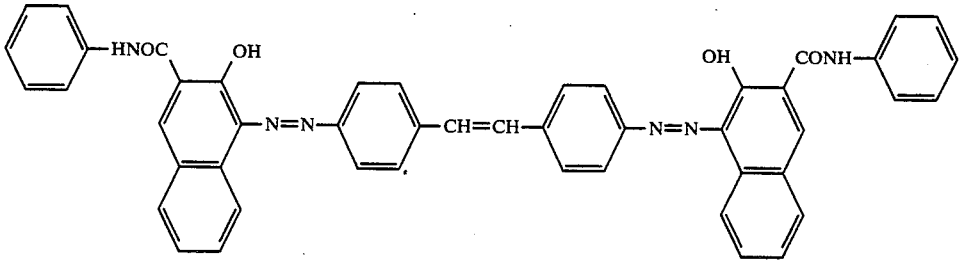
(4)
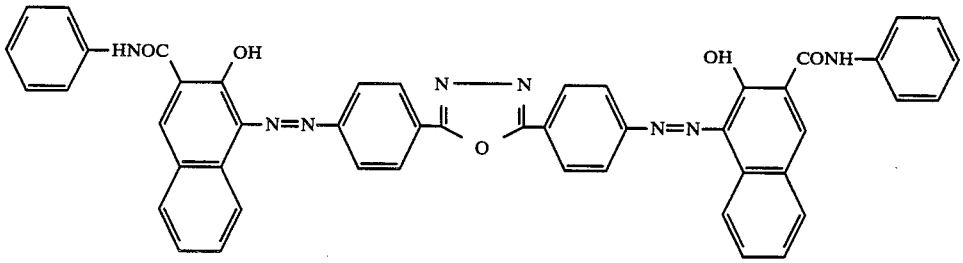
(5)
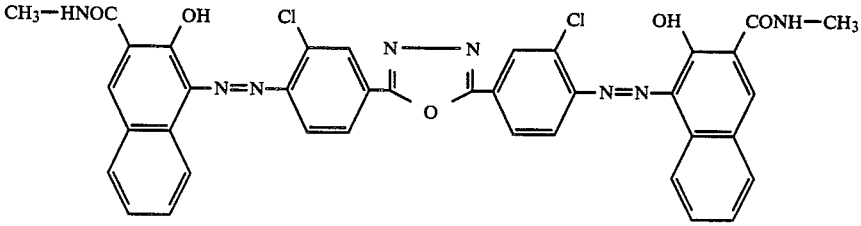
(6)
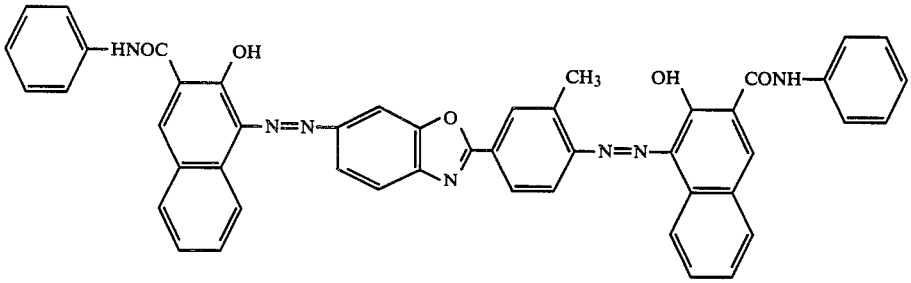
phthalocyanine pigments such as (7) copper phthalocyanine, (8) aluminum chloride phtalocyanine, (9) nickel phthalocyanine, and (10) metal-free phthalocyanine; and perylene pigments such as
(11)
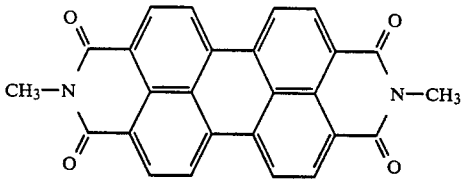
-continued
(12)
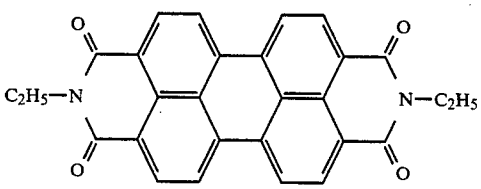
The charge transport layer 63 is electrically connected to the charge generation layer 62 and has an ability, in the presence of an electric field, not only to receive the charge carrier injected from the charge generation layer 62, but also to transport the charge carrier to the surface.

Any substances capable of transporting the charge carrier in the charge transport layer 63, referred to hereinafter as "charge transport substances", are preferably substantially nonsensitive to the wavelength region of an electromagnetic wave, to which the above-mentioned charge generation layer 62 is sensitive. The expression "electromagnetic wave" as used herein includes the definition of "rays" in a broad sense including $\gamma$ rays, X rays, ultraviolet rays, visible rays, near-infrared rays, infrared rays, and far-infrared rays. When the photosensitive wavelength region of the charge transport layer 63 is in agreement with or overlaps that of the charge generation layer 62, the charge carriers generated on both the layers are trapped, resulting in a decreased sensitivity.

The charge tranport substances comprise those capable of transporting an electron and those capable of transporting a positive hole. The former electron transporting substances may include electron absorbing substances such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-9-fluorenone, 2,4,7-trinitro-9-dicyanomethylenefluorenone, 2,4,5,7-tetranitroxanthone, and 2,4,8-trinitrothiaxanthone, including the high molecular compounds thereof.

The hole transport substances include: pyrene; N-ethylcarbazole, N-isopropylcarbazole, N-methyl-N-phenylhydrazine-3-methylidene-9-ethylcarbazole, N,N-diphenylhydrazine-3-methylidene-9-ethylcarbazole, N,N-diphenylhydrazino-3-methylidene-10-ethylphenothiazine, N,N-diphenylhydrazino-3-methylidene-10-ethylphenoxazine, hydrazones such as p-diethylaminobenzaldehyde-N,N-diphenylhydrazone, p-diethylaminobenzaldehyde-N-$\alpha$-naphthyl-N-phenylhydrazone, p-pyrrolidinobenzaldehyde-N,N-diphenylhydrazone, 1,3,3-trimethylindolenine-$\omega$-aldehyde-N,N-diphenylhydrazone, and p-diethylbenzaldehyde-3-methylbenzthiazolinone-2-hydrazone and the like; pyrazolines such as 2,5-bis(p-diethylaminophenyl)-1,3,4-oxadiazole, 1-phenyl-3-(p-diethylaminostyryl)-5-(p-diethylaminophenyl)pyrazoline, 1-[quinolyl(2)]-3-(p-diethylaminostyryl)-5-(p-diethylaminophenyl)-pyrazoline, 1-[pyridyl(2)]-3-(p-diethylaminostyryl)-5-(p-diethylaminophenyl)pyrazoline, 1-[6-methoxy-pyridyl(2)]-3-(p-diethylaminostyryl)-5-(p-diethylaminophenyl)-pyrazoline, 1-[pyridyl(3)]-3-(p-diethylaminostyryl)-5-(p-diethylaminophenyl)pyrazoline, 1-[lepidyl(2)]-3-(p-diethylaminostyryl)-5-(p-diethylaminophenyl) pyrazoline, 1-[pyridyl(2)]-3-(p-diethylaminostyryl)-4-methyl-5-(p-diethylaminophenyl)pyrazoline, 1-[pyridyl(2)]-3-($\alpha$-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-($\alpha$-benzyl-p-diethyl-aminostyryl)-5-(p-diethylaminophenyl)pyrazoline, and spiropyrazoline and the like; oxazole compounds such as 2-(p-diethylaminostyryl)-6-diethylaminobenzoxazole, and 2-(p-diethylaminophenyl)-4-(p-dimethylaminophenyl)-5-(2-chlorophenyl)-oxazole and the like; thiazole compounds such as 2-(p-diethylaminostyryl)-6-diethylaminobenzothiazole and the like; triarylmethane compounds such as bis(4-diethylamino-2-methylphenyl)-phenylmethane and the like; polyaryl alkanes such as 1,1-bis-(4-N,N-diethylamino-2-methylphenyl)-heptane, 1,1,2,2-tetrakis (4-N,N-dimethylamino-2-methylphenyl)ethane and the like; triphenylamine, poly-N-vinylcarbazole, polyvinylpyrane, polyvinylanthracene, polyvinylacridine, poly-9-vinylphenylanthracene, pyrene-formaldehyde resin, and ethylcarbazole formaldehyde resin and the like.

The charge transport layer 63 may be obtained by coating on the charge generation layer 62 a coating liquid containing the above-described silica contained in these charge transport substances and binder resins by the above method to form a film. The binder resins of the layer 63 include insulating resins such as acrylic resins, polyarylates, polyesters, polycarbonates, polystyrenes, acrylonitrile-styrene copolymers, acrylonitrile-butadiene copolymers, polyvinylbutyral, polyvinylformals, polysulfones, polyacrylamides, polyamides, and chlorinated rubbers; or poly-N-vinylcarbazoles, polyvinylanthracenes, and polyvinylpyrenes in appropriate proportions contained in the layer 63.

The above silica contents are 1–150 parts by weight, and preferably 10–50 parts by weight, per 100 parts by weight of the binder resins. Dispersion may be accomplished by conventional methods using a homogenizer or a ball mill. The film thickness of the layer 63 cannot be made larger than is required because the charge carrier can be transported in a limited range. The thickness is usually from 5 to 30 microns, and is preferably from 8 to 20 microns. The above-mentioned coating methods may be employed when forming the layer 63 by coating.

Another preferably embodiment of the present invention is shown in FIG. 6B. Exemplified in the embodiment is an electrophotographic photosensitive member using a photosensitive layer comprising the layer 63 adjoined to the electroconductive substrate 61 and the layer 62 overlying the layer 63. The layer 62 which is the surface layer may be obtained by coating on the layer 63 a coating liquid prepared by adequately dispersing a photoconductive substance and the above-described silica in the afore-mentioned binder resin liquid. In still another embodiment, as shown in FIG. 6C, the protective layer 64 containing the above silica in the binder resin may also be superimposed on a photosensitive layer of a laminated structure comprising the layers 62 and 63.

Figure 6D:
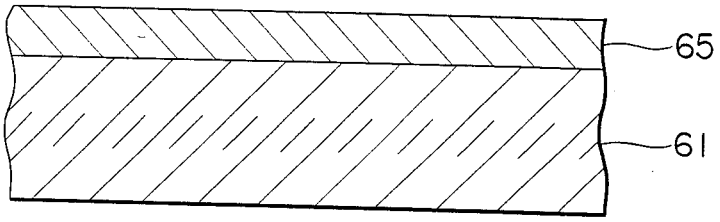
Figure 6E:
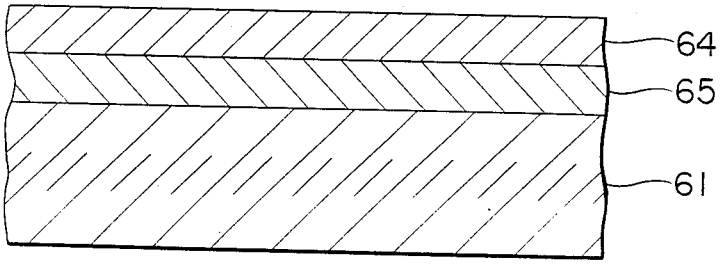

Another preferable embodiment, as shown in FIGS. 6D and 6E, may use the layer 65 containing organic photoconductive substances such as the abovenoted hydrazones, pyrazolines, oxazoles, thiazoles, triarylmethanes, polyarylalkanes, triphenylamines, and poly-N-vinylcarbazoles; inorganic photosensitive substances such as zinc oxide, cadmium sulfide, and selenium; or binder resin liquids containing the above organic solvent-type silica for the protective layer 64 of the photoconductive layer 65 containing these photoconductive substances. The binder resins used herein are insulating resins such as acrylic resins, polyarylates, polyesters, polycarbonates, polystyrenes, acrylonitrile-styrene copolymers, acrylonitrilebutadiene copolymers, polyvinylbutyrals, polyvinylformals, polysulfons, polyacrylamides, polyamides, or chlorinated rubbers; poly-N-vinylcarbazoles, polyvinylanthracenes, polyvinylpyrenes and the like in an appropriate proportions. The content of the above silica in the binder resins is in the range of 1–200 parts by weight, preferably in the range of 1–150 parts by weight, and more particularly in the range of 10–50 parts by weight, per 100 parts by weight of the binder resins.

The display apparatus described above is an example in which a photoconductive layer is used in the image holding member, and other applicable methods are also exemplified by a method for producing a toner image by providing an electrostatic charge image on a dielectric layer using pin electrodes for inputting signals other than light, and a method for producing a magnetic toner image by inputting current signals into a easily magnetizable stylus using a magnetic toner.

Representative image holding members in the absence of any photoconductive layer are provided with an insulating layer as the image holding layer, and typical examples of the uses of the image holding member are described below:

(1) Japanese Patent Application Publication No. 7115/1957, No. 8204/1957, and No. 1559/1968 disclose processes for transferring electrostatic images formed on electrophotographic photosensitive members, for the purpose of improvement in the repeating serviceability of the members, to image holding members without any photoconductive layer, the transfer being carried out for development, and then transferring a toner image to recording members. The image holding members used in the electrophotographic processes may be applied to the present invention.

(2) Japanese Patent Application Publication No. 30320/1970 and No. 5063/1973 and Japanese Patent Laid-open No. 341/1976 disclose other electrophotographic processes. In these processes, electrostatic images are produced by predetermined processes on screen-shaped electrophotographic photosensitive members having numerous fine openings and the images are reproduced on image holding members without any photoconductive layers by modulating the corona ion current by means of corona charging treatment on image holding members without photoconductive layers via the image, and finally the images on the members are toner-developed and transferred to recording members to produce the final images. The image holding members in the process may be applied to the present invention.

(3) In other electrophotographic processes, toner images produced on electrophotographic photosensitive members or photoconductive layers-free image holding members are further transferred to other photoconductive layers-free images holding members without directly transferring the toner images to recording members, and the images are transferred from the image holding members to recording members and are finally fixed. The image holding members used for the processes may be applied to the present invention. The processes are especially useful for production of color images and high-speed copying. The recording members used herein are usually prepared of flexible materials such as paper and films. Accordingly, more accurately positioned color images may be obtained by transferring trichromatic images to image holding members producible by such materials that result little deformation and then transferring the trichromatic images to recording members at once than by transferring each color image of the trichromatic images to recording members while accurately positioning each color image. Transfer of toner images to recording members via image holding members is also effective for speed-up of copying.

(4) In addition to the above, electrostatic images may be obtained by applying electrical signals to dielectric members having image holding members via needle electrodes to produce toner images. The processes are disclosed in Japanese Utility Model Laid-open No. 55061/1982 and others. The image holding members may be applied to the present invention.

(5) Image holding members used in a process in which visible images are formed on the surfaces of the image holding member by means of toners of magnetic powder and magnetic fluids, using an easily magnetizable stylus, according to magnetized signals may be applied to the present invention.

Figure 5C:
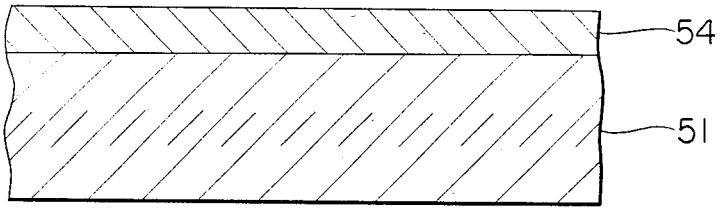

Examples of an image holding member without any photoconductive layer are apparent from FIG. 5C. In another embodiment of the preesnt invention, as shown in FIG. 5C, the surface layer 54 containing a hydrophobic silica powder in a binder may be superimposed on the electroconductive substrate 51.

The layer 54 may contain appropriate pigments or dyes such as titanium oxide, zinc oxide, or tin oxide for providing the layer with electrical resistance.

The conductive substrate 51 or 61 may be made of an inherently conductive material, for example, aluminum, aluminum alloy, copper, zinc, stainless steel, vanadium, molybdenum, chromium, titanium, nickel, indium, gold, or platinum; or made of a plastic resin (for example, polyethylene, polypropylene, polyvinyl chloride, polyethylene terephthalate, acrylic resin, or polyethylene fluoride) coated with a film of aluminum, aluminum alloy, indium oxide, tin oxide, or an alloy of indium oxide-tin oxide combined through a process of vacuum vapor deposition; or made of a plastic substrate coated by conductive particles of a suitable material (for example, carbon black, or silver) together with a suitable binder, or made of a plastic or paper impregnated with conductive powders, or made of a plastic resin having conductive polymer. Said substrate may be in the form of a cylinder, sheet, or plate. An underlying layer having a barrier function and an adhesion function may be formed between the conductive substrate 51 or 61 and the photoconductive layer 52 or 65, between the substrate 51 and the top layer 54, or between the substrate 61 and the charge generation layer 62 or the charge transport layer 63. The underlying layer may be formed by casein, polyvinyl alcohol, nitrocellulose, ethylene-acrylic acid copolymer, polyamide (Nylon 6, Nylon 66, Nylon 610, copolymer Nylon, or alkoxymethylated Nylon), polyurethane, gelatin, aluminum oxide or the like, with a thickness of 0.1 to 5 microns, preferably 0.5 to 3 microns.

Another preferable embodiment of the present invention has the third feature that an organic-solvent-dispersing-type silica powder is contained in the charge generation layer 62 in a form of colloidal silica.

Therefore, this type of electrophotographic photosensitive member can be remarkably improved in the close contact property and adhesivity between the adjacent layers and the sensitivity characteristics by incorporating organic-solvent-dispersing-type silica powders in the charge generation layer.

Further, even after durability that by using repeatedly, the photosensitive member shows no change in close contact property and sensitivity characteristics. That is, a stable photosensitive member can be obtained. In addition, even under change of environment, stable characteristics are unexpectedly obtained and the humidity resistance is high.

The organic-solvent-dispersing-type silica powders are contained in an amount of 1–150 parts by weight, preferably 10–50 parts by weight per 100 parts by weight of a binder in the charge generation layer.

The dispersion can be achieved by a standard process such as a process using a homogenizer, ball mill or sand mill.

As is clear from above, the present invention is based on a discovery that, in an apparatus for forming image by producing electrostatic images and/or toner images, it is advantageous for the purpose of keeping image quality stable that the image holding member contains hydrophobic silica powders.

This result is concerned with an image forming surface so that this invention can be effectively used for most of the image forming systems regardless of the image forming method. Therefore, the following examples are not for limiting the present invention, but for illustration thereof.

EXAMPLE 1

A photoconductive image holding belt (shown in FIG. 2) was prepared through a process mentioned below. The image holding belt of this example comprises three layers: a top layer, an intermediate layer, and a photoconductive material layer placed on a transparent conductive base film.

For the transparent conductive base film, "CELEC-KEC", (tradename, supplied by Daiseru Kagaku K.K.) was used. The coating liquids for the top, the intermediate, and the photoconductive material layers were prepared as follows:

(1) Coating Liquid for Photoconductive Material Layer

A coating liquid was prepared by dispersing 100 parts by weight of CdS powder which is made sensitive to a semiconductor layer (820 nm) by doping with Cu and In and 7 parts by weight of polybutyl methacrylate having an average molecular weight of 10,000 in methyl ethyl ketone, and kneading by a roll mill.

(2) Coating Liquid for Intermediate Layer

A coating liquid was prepared with 37.5 parts by weight of $TiO_2$ pigment and 150 parts by weight of ethylene-acrylic acid copolymer (ZAIKTHENE-A solid content 25 wt. %, a product of Seitetsu Kagaku Co., Ltd.) dispersed in a mixture of 36 parts by weight of water and 27 parts by weight of ethanol in a ceramic ball mill through a 40-hour dispersion process.

(3) Coating Liquid for Top Layer

A mixture of 30 parts by weight of $TiO_2$ pigment, 20 parts by weight of alkyd silicone denaturated resin (KR-201, a product of Shinetsu Chemical Co., Ltd. with a non-volatile substance content of 50 wt. %), and 5 parts by weight of an organic solvent dispersible type silica powder was admixed with xylene so that the solid content was adjusted to 30 wt. % and subjected to a 40-hour dispersing process in a ceramic ball mill. $TiO_2$ was used to increase the whiteness of the image-displaying surface, and to adjust the electric resistance of the intermediate and top layers.

The coating liquids thus prepared were applied one over another on said transparent conductive base film by using a roll coater. The coating liquid for photoconductive material layer was first coated on the film, so as to obtain a thickness of 70 microns when dried up. The intermediate layer was next coated on the photoconductive layer in the thickness of 2 microns when dried. Finally, the top layer was coated on the intermediate layer in the thickness of 15 microns when dried, thus obtaining an image-holding belt. This belt was mounted on the image-displaying device (shown in FIG. 1) and subjected to a repeated image display with a conductive magnetic toner prepared by kneading 40 parts by weight of melted polymethyl methacrylate resin and 60 parts by weight of magnetite, by pulverizing the whole and by causing adherence of fine, conductive carbon powders to the pulverized particles by a hot air blast. The contamination on the surface of this image-holding member was measured by a reflect density meter, after repetition of image-display, with the result that the density after 10,000 repetitions of image display was 012, as compared to the initial density of 0.18, giving sharp image without any contamination of the base.

COMPARISON EXAMPLE 1

An image-holding belt was prepared as in Example 1, but without an organic solvent dispersing type silica powder (OSCAP-3102, tradename, supplied by Shokubai Kasei K.K.).

As in the case of Example 1, the contamination of base of the image-holding body upon repeating the image displaying was measured, with the unfavorable result that the base density was 0.32 after 10,000 repetitions, as compared to 0.18 of the initial density, and a rough surface was disadvantageously observed.

EXAMPLES 2 to 5

Image-holding belts were prepared in the same way as in Example 1, but alkyd denaturated silicon in Example 1 was replaced by the resins as shown in Table 1, and the image-holding belts each were measured for their base contamination as in Example 1 with the result showing a lower base contamination and an improved durability, with the result as shown in Table 1.

TABLE 1

| Example | Resin | Initial Density | Density after 10,000 Repetitions |
|---|---|---|---|
| 2 | Saturated Polyester Resin ("Vylon 200", tradename, supplied by Toyo Boseki K.K.) | 0.20 | 0.23 |
| 3 | Styrene-methylmethacrylate Copolymer (ESTYLENE-MS-200, tradename, supplied by Shin Nihon Seitetsu Kagaku Kogyo K.K.) | 0.18 | 0.20 |
| 4 | Acryldenaturated silicone (KR-3093, trandmane, supplied by Shinetsu Chemical Co., Ltd.) | 0.16 | 0.19 |
| 5 | Urethane Denaturated Polybutadiene (TP-1001, tradename, supplied by Nippon Sode Co., Ltd.) | 0.18 | 0.25 |

Image holding belts were prepared with the use of the resins in Table 1 above, through the same process as in Comparison Example 1. That is, the coating liquids contained on organic-solvent-dispersing-type silica powder. The resulting increase in the base density after repetitions was unfavorably large for all the belts.

EXAMPLE 6

An image-holding belt was prepared by forming a top layer as shown in Example 1 in the thickness of 10 microns after dried on a magnetic tape made of polyester film covered with a thin $CrO_2$ film (Magnetic record layer).

The belt was operated in an image-producing process in a manner similar to that effected in the apparatus of FIG. 1. However, the laser scanner was replaced by a magnetic head-set in front of the development station A, to produce magnetic latent images by the input of a bar-code pattern signals. In the developing apparatus of FIG. 2, the stationary magnetic roll employed brought about no magnetization at the developing parts so as to prevent the magnetic image from being disturbed.

The toner image produced with said unit had a contrast sufficient to be read out by the OCR head. The produced images were erased by a thermal quenching applied from the rear of the image-holding belt. With this process, the image-holding belt provided constantly stable OCR read out signals at each repetition of the image production.

EXAMPLE 7

A coating liquid for a charge generation layer was prepared with 1.0 part by weight of the charge generation substance of the formula mentioned below:

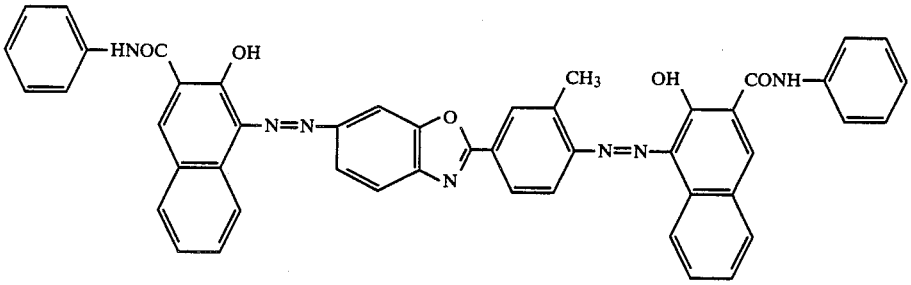

and 0.5 part by weight of cellulose resin dispersed in 98.5 parts by weight of methyl ethyl ketone (MEK) in a sand mill. This coating liquid was applied to an aluminum cylinder, through an immersion coating method, and dried to form a charge generation layer in the thickness of 0.1 micron (dried). Next, a coating liquid for a charge transport layer was prepared with 10 parts by weight of a charge transport substance of the formula mentioned below,

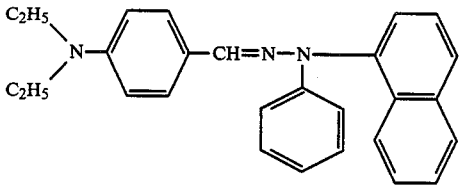

20 parts by weight of styrene resin, and 1 part by weight of hydrophobic silica powder (AEROSIL R-972, tradename, supplied by Japan Aerosil Co.) dispersed in 120 parts by weight of toluene. This coating liquid was applied to the previously formed charge generation layer through the immersion coating method, and dried for 60 min. at 100° C. to form a charge transport layer of 15 micron in thickness dried.

COMPARISON EXAMPLE 2

A comparative photosensitive member for electrophotography was prepared through the same process as in Example 7, except for the elimination of the hydrophobic silica powder (AEROSIL R-972) in the charge transport layer.

The photosensitive members of Example 7 and Comparative Example 2 were mounted on an electronic copying machine, which was equipped with corona charging, image exposure by a halogen lamp light source, dry development with toner, toner transfer to plain paper, cleaning by polyurethane rubber blade, and static discharging exposure, and operated to form images in 2000 consecutive repetitions. The photosensitive member of Example 7 formed the 2000th image copy with a slightly deteriorated quality (due to fog) as compared to that of the initial copy, while the photosensitive member of Comparison Example 2 formed the 2000th copy with a remarkable deterioration due to fog as compared to that of the initial copy.

After the production of the 2000th copy, an observation was made and it was found that the photosensitive member of Example 7 of this invention was slightly contaminated while the photosensitive member of Comparative Example 2 was overlaid with a scattering of the residual toner, aggro and when the toner was removed, there were scratches and wear and tear on the surface of the photosensitive member.

EXAMPLE 8

A dispersion liquid was prepared with 15 g of zinc oxide powder, 0.05 g of Rose Bengal dye, 2 g of hydrophobic silica powder (AEROSIL R-972), and 8 g of acrylic resin (Dianal LR 472, a product of Mitsubishi Rayon co., Ltd.) dispersed in 20 ml of toluene, and 2 ml of methanol dispersed in a ball mill. This dispersion liquid was applied to an aluminum cylinder by the immersion coating method and dried for 40 min. at 100° C., forming a 15 microns thick dry film.

The photosensitive member thus prepared was operated through the same process, and mounted on the same electronic copying machine, as Example 7, to obtain copy images, with the result that the 2000th copy was nearly equal in the image quality to the initial copy image, both copies showing satisfactory qualities, and after producing the 2000th copy, the surface of the photosensitive member remained clean without any scattering of the residual toner and/or scratches.

EXAMPLE 9

A photoconductive layer was formed in the same way as in Example 8, except for the elimination of AEROSIL R-972, and it was laminated with a protective layer. This protective layer was formed by preparing a dispersion liquid with 30 parts by weight of polyarylate resin (U-100, a product of Unichika Ltd.) and 2 parts of hydrophobic silica powder (AEROSIL R-972), dispersed in 100 parts of chlorobenzene.

This dispersion liquid was applied to the previously formed photoconductive layer, through the immersion coating method, and by drying this liquid for 30 min. at 100° C. to form a 1 micron thick dry film.

The photosensitive member of Example 9 was operated through the same process and on the same electronic copying machine as in Example 7, to obtain copy images, with the result that the 2000th copy was almost equally satisfactory as compared to the initial copy, and after producing the 2000th copy the surface of the photosensitive body remained clean without any scattering of residual toner and scratches.

EXAMPLE 10

A coating liquid was prepared with 100 parts by weight of Cds powder doped with Cu and In sensitive to a semiconductor laser (820 nm) and 7 parts by weight of polybutyl methacrylate having an average molecular weight of 10,000 dispersed in methyl ethyl ketone and kneading the whole in a roll mill. This liquid was applied to a transparent conductive base film (CELEC-K-EC, a product of Daicel Ltd.) with a roll-coater to form a photoconductive layer of 60 microns when dried.

Another coating liquid was prepared with 40 parts by weight of $TiO_2$ pigment, 10 parts by weight of polystyrene (ESTYLENE MS-200, a product of Shin Nippon Seitetsu Kagaku Co., Ltd.) and 1 part by weight of hydrophobic silica powder (Aerosil R-972) in toluene dispersed in a sand mill to obtain a liquid having a solid content of 30% by weight.

$TiO_2$ pigment was added to increase the whiteness of the image-displaying surface and adjust the electric resistance of the top layer.

And this liquid was applied to the previously formed photoconductive layer with a roll coater and dried to obtain a 5 micron thick dry film.

The image holding belt, thus prepared, was mounted on the image-displaying unit as shown in FIGS. 1 and 2, and driven to produce images 5000 times. As a result, the 5000th image was nearly equal in quality to the initial image, both images giving satisfactory image qualities, and after producing the 5000th image, it was found that the image-displaying surface remained clean and without contamination or scratches.

EXAMPLE 11

An image holding belt was prepared by forming the top layer, as in the case of Example 4, in the thickness of 10 microns (when dried) on a magnetic tape of a polyester film covered with a thin $CrO_2$ film.

The belt was operated in an image-producing process which was assembled to a unit in a way similar to that in FIGS. 1 and 2, except that the laser scanner was replaced by a magnetic head set in front of the development station A to produce magnetic latent images by the input of a bar-code pattern, and the developing apparatus as shown in FIG. 3 employed a stationary magnetic roll housed in the rotary sleeve 16. This stationary magnetic roll is such one which does not magnetize the developing part so as to prevent the magnetic latent image from being disturbed. The toner image produced with this unit had a contrast sufficiently to readable by the OCR head. The produced images were erased by a thermal quench method applied from the rear of the image-holding belt. With this process, the image holding belt constantly provided stable OCR read out signals at each repetition of the image production.

EXAMPLE 12

A coating liquid for a charge generation layer was prepared with 1.0 part by weight of the said charge generation substance No. (6), and 0.5 part by weight of cellulose resin, 98.5 part by weight of methyl ethyl ketone mixed and dispersed in a sand mill. This coating liquid was applied to an aluminum cylinder through the immersion coating method and dried to form a charge generation layer of 0.1 micron thickness after drying.

Next, a coating liquid for a charge transport layer was prepared with 10 parts by weight of the charge transport substance of the following formula:

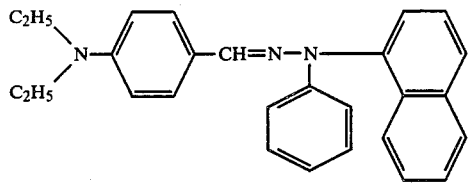

20 parts by weight of styrene resin, and 2 parts by weight of organic solvent dispersing type silica (OSCAP-3102) dispersed in 120 parts by weight of toluene. This coating fluid was applied to the previously-formed charge generation layer through the immersion coating method and dried for 60 min. at 100° C. to form a charge transport layer of 15 microns thick.

COMPARATIVE EXAMPLE 3

A comparative photosensitive member for electrophotography was prepared through the same process as in Example 12 except for the elimination of the organic solvent dispersing type silica (OSCAP-3102) from the charge transport layer.

The photosensitive members for electrophotography of Example 12 and Comparative Example 3 were mounted on an electrophotographic copying machine provided with the capabilities of a −5.6 KV corona charging, image exposure by a tungsten halogan lamp light source, dry toner development, toner transfer to plain paper, cleaning with a polyurethane rubber blade, and discharging-exposure, and operated to form images in 2000 consecutive repetitions.

The photosensitive member of Example 12 formed the 2000th copy showing a slightly deteriorated image quality (due to fog) as compared to that of the initial copy. However, the quality of the 2000th copy was within satisfactory limits.

While the photosensitive member of Comparative Example 3 formed the 2000th copy showing a remarkable fog, with a much deteriorated image quality as compared to the initial copy.

After the production of the 2000th copy, an observation was made and it was found that the photosensitive member of Example 12 of this invention was a little contaminated, while the photosensitive member of Comparative Example 3 was affected by the scattered residual toner, impaired by scratches and otherwise contaminated.

EXAMPLE 13

A 1 micron thick underlying layer was formed by coating, through an immersion coating method, a 5% solution of polyamide resin ("Amylan", tradename, supplied by Toray Co.) in methanol on a substrate of an aluminum cylinder measuring 80ϕ×300 mm.

Next, a dispersion liquid for a photoconductive layer was prepared by dissolving 5 g of N-ethyl-phenothiazine-3-aldehyde-N',N'-diphenylhydrazine and 5 g of polyvinylcarbazole (molecular weight: 300,000) in 70 ml of tetrahydrofuran to obtain a solution, adding 1.0 g of copper-phthalocyanine to the solution and subjecting the whole to a dispersion process in a ball mill. The resulting dispersion was applied to the previously formed underlying layer through the immersion-coating method and dried to form a photoconductive layer of 8 micron thick.

Then, a liquid for the protective layer was prepared with 30 parts by weight of polyarylate resin ("U-100", a product of Unichika Ltd.) and 5 parts by weight of organic solvent dispersing type of silica (OSCAP-3102) dispersed in 100 parts by weight of toluene. This liquid was applied to the previously formed photoconductive layer by the immersion coating method, and dried for 30 min. at 100° C. to form a dry film of 1 micron thickness for the protective layer.

The photosensitive member thus prepared was mounted on the same electrophotographic copying machine and operated with the same process as used in Example 12 to obtain copy images in consecutive repetitions, with the result that the 2000th copy image was nearly equal in quality to the initial copy image, both copies showing satisfactory qualities, and after reproducing the 2000th copy image, the surface of the photosensitive body had remained clean without residual toner scattering and scratches thereon.

EXAMPLE 14

A coating fluid was prepared with 15 g of zinc oxide powder, 0.05 g of Rose Bengal dye, 2 g of organic solvent dispersing type silica (OSCAP-3102) and 8 g of acrylic resin ("LR 472", a product of Mitsubishi Rayon Co., Ltd.) dispersed in a mixture of 20 ml of toluene and 2 ml of methanol in a ball mill. This liquid was applied through the immersion coating method, to an aluminum cylinder coated with a polyamide as an underlying layer, as in the case of Example 13, and dried for 40 min. at 100° C. to form a 15 microns thick dry film. The photosensitive member thus prepared was mounted on the same electrophotographic copying machine and operated through the same process as used Example 12 to obtain copy images in repetitions, with the results that the 2000th copy image was nearly equal in quality to the initial copy image, both copies showing satisfactory qualities, and after producing the 2000th copy image the surface of the photosensitive body had remained clean without any residual toner scatterings or scratches.

EXAMPLE 15

An amorphous silicon charge generation layer of 0.3 micron thickness was formed on a 0.2 mm thick aluminum substrate placed in a vacuum device, by sufficiently deaerating the vacuum device, then introducing a mixture of hydrogen gas and silane gas (15 volume % based on the hydrogen gas into the device, and applying a 13.5 MHz high-frequency electric field to cause glow discharge. After returning the vacuum device to atmospheric pressure, the sample was taken out and the resulting charge generation layer was coated with a coating liquid for a charge transport layer which was used to prepare the photosensitive member of Example 12. With the use of a Mayer's bar, and after being dried for 30 min. at 100° C., a 15 microns dry film was formed for a charge-transport layer.

The photosensitive body, thus obtained, was mounted on a charge-exposure test equipment and subjected to corona charging at ⊖5 KV, immediately followed by the irradiation with light images, through a transmission type test chart, illuminated by a tungsten lamp, and subsequently cascaded with a positively charged developer (including toner and carrier) on the surface of the photosensitive member, obtaining an excellent toner image.

Example 16

A coating fluid for the electric charge generating layer was prepared with 10 parts by weight of β type copper phthalocyanine pigment (a product of Toyo Ink Mfg. Co., Ltd.) which was refined through a hot filtration with water, ethanol and methyl ethyl ketone in sequence, mixed with 100 parts by weight of a 5% linear polyester resin ("Vylon 300", tradename, produced by Toyo Boseki K.K.) solution in cyclohexanone, and 0.5 part by weight of organic solvent dispersing type silica powder ("OSCAP 3102") which was added subsequently, the whole material was subjected to a dispersing operation in a sand mill having 1ϕ glass beads for 5 hours.

The resulting dispersion liquid was mixed with 80 parts by weight of methyl ethyl ketone and applied to a 80ϕ×300 mm aluminum cylinder substrate by the immersion coating method and dried for 5 min. at 100° C. followed by allowing the cylinder to stand for 1 hour, forming an charge generation layer of a coated amount of 180 mg/m$^2$.

Next, a coating fluid for the electric charge-transmitting layer was prepared with 10 parts by weight of 1-(pyridyl-(2)-3-(4-N,N-diethylaminostyryl)-5-(4-N,N-diethylaminophenyl)pyrazoline and 10 parts by weight of polysulfonic resin ("U del P 1700", a product of UCC Corporation) dissolved in 80 parts by weight of monochlorobenzene. The solution thus obtained was coated, on the previously formed charge generation layer through an immersion coating method and dried by hot air flow at 100° C. to form a 12 microns thick charge transport layer resulting in a photosensitive member for electrophotography.

COMPARATIVE EXAMPLE 4

A comparative photosensitive member was prepared through the same process as Example 16 except for the elimination of the organic-solvent-dispersing-type silica powder (OSCAP-3102) contained in the charge generation layer of Example 16.

The photosensitive members for electrophotography of Example 16 and Comparative Example 4 were mounted on a electronic copy machine which was furnished with the processes of ⊖5.6 KV corona charging, image exposure by a tungsten lamp, dry toner development, toner transfer to plain paper, cleaning with a polyurethane rubber blade and discharging-exposure, and operated to examine the resultant characteristics. The photosensitive member of Example 16 was found to have a sensitiveity of 5.5 lux.sec. at a half-decay exposure, E ½ (lux.sec) and give a highly clear image, and 5.8 lux.sec. at E ½ after a 1000 repetition endurance that with an adhesion of 100/100 measured by the cross hatch test and almost no peeling off. The photosensitive member of Comparative Example 4 was found to have a sensitivity of 5.7 lux.sec. at E ½. After an endurance test as made in Example 16, the sensitivity was 6.8 lux.-sec. at E ½ showing a deterioration and a weak adhesion of 30/100.

EXAMPLE 17

An underlying layer was prepared with a casein solution in ammonia and water (a mixture of casein 10 g, 28% aqueous ammonia 1 g, and water 220 ml) applied to a 80$\phi\times$300 mm aluminum cylinder through the immersion coating method and dried to obtain a film of a coated amount of 1.0 g/m$^2$.

Next, a charge generation layer was formed through the same process as in Example 16 except for the replacement of the binder in the charge generation layer of Example 16 by polyurethane resin ("CLISVON 5816", a product of Dainippon Ink & Chemicals, Inc.), consequently, a photosensitive member for electrophotography was obtained.

COMPARATIVE EXAMPLE 5

A comparative photosensitive member was prepared through the same process as in Example 17 except for the elimination of the organic-solvent-dispersing-silica powder (OSCAP-3102) contained in the charge generation layer of Example 17.

The photosensitive members of Example 17 and Comparative Example 5 were mounted on the same electrophotographic copy machine as in Example 16 and operated in the same process to evaluate the characteristics of the photosensitive member having an underlying layer.

The photosensitive member of Example 17 was found to have a sensitivity of 5.7 lux.sec. at E ½, and a sensitivity of 5.9 lux.sec. after the endurance test, with an adhesion of 100/100 and no peeling off. While the photosensitive member of Comparative Example 5 was found to have a sensitivity of 6.2 lux.sec. at E ½, and 6.71 after the endurance test, with an adhesion of 70/100 and a little peeling off.

What we claim is:

1. An image-holding member comprising a conductive substrate and a top layer capable of holding electrostatic images and/or toner images characterized in that a top layer is formed by applying a coating liquid containing an organic solvent-dispersing silica and a binder resin, wherein the silica is in the form of particles having a surface area of 10 m$^2$/g to 1000 m$^2$/g.

2. The image holding member as defined in claim 1, wherein the top layer is a protective layer for a photoconductive layer.

3. The image holding member as defined in claim 1, wherein the top layer is a photoconductive layer.

4. The image holding member as defined in claim 2, wherein the photoconductive layer has a laminate structure of a charge generation layer and a charge transport layer.

5. The image holding member as defined in claim 4, wherein the charge transport layer overlies the charge generation layer.

6. The image holding member as defined in claim 4, wherein the charge generation layer overlies the charge transport layer.

7. the image holding member as defined in claim 3, wherein the photoconductive layer has a charge generation layer and a charge transport layer in a laminate form and the charge transport layer is the top layer.

8. The image holding layer as defined in claim 1, wherein the top layer is a film containing a white pigment or dye.

9. the image holding member as defined in claim 8, wherein the top layer is a protective layer for the photosensitive layer.

10. The image holding member as defined in claim 8, wherein the white pigment is titanium oxide pigment, zinc oxide pigment, or tin oxide pigment.

11. The image holding member as defined in claim 1, wherein the white pigment is titanium oxide.

12. The image holding member as defined in claim 1, wherein the hydrophobic silica is in the power of a primary particle diameter of 10Å to 1000Å.

13. The image holding member as defined in claim 1, wherein the hydrophobic silica is in the power of a primary particle diameter of 10Å to 500Å.

14. The image holding member as defined in claim 1, wherein the hydrophobic silica is in a form of particles having a surface area of 10 m$^2$/g to 500 m$^2$/g.

15. The image holding member as defined in claim 1, wherein 1 to 200 parts by weight of the hydrophobic silica is contained in 100 parts by weight of the binder resin.

16. The image holding member as defined in claim 1, wherein 1 to 150 parts by weight of hydrophobic silica is contained in 100 parts by weight of the binder resin.

17. The image holding member as defined in claim 1, wherein 10 to 50 parts by weight of the hydrophobic silica is contained in 100 parts by weight of the binder resin.

18. The image holding member as defined in claim 1, wherein the dispersant of the hydrophobic silica is methanol, ethanol, n-propyl alcohol, iso-propyl alcohol, n-butyl alcohol, tert-butyl alcohol, pentanol, ethylene glycol, glycerin, ethyl-cellosolve, dimethylformamide, toluene, tetrahydrofuran, acetone, benzene, or xylene.

19. A photosensitive member for electrophotography having a conductive substrate, a charge generation layer and a charge transport layer in a laminate structure characterized in that the charge generation layer is formed by applying a coating liquid containing an organic-solvent-dispersing silica, wherein the silica is in the form of particles having a surface area of 10 m$^2$/g to 1000 m$^2$/g.

20. The photosensitive member for electrophotography as defined in claim 19, wherein the charge transport layer overlies the charge generation layer.

21. The photosensitive member for electrophotography as defined in claim 20, wherein an intermediate layer is provided between the charge generation layer and the conductive substrate.

22. The photosensitive member for electrophotography as defined in claim 19, wherein the organic-solvent-dispersing-type silica is in a form of the powder of a primary particle diameter of 10Å to 1000Å.

23. The photosensitive member for electrophotography as defined in claim 19, wherein the organic-solvent dispersing type silica is in a form of the powder of a primary particle diameter of 10Å to 500Å.

24. The photosensitive member for electrophotography as defined in claim 19, wherein the organic-solvent-dispersing-type silica is in a form of powder with a surface area of 10 m$^2$/g to 500 m$^2$/g.

25. An imaging-holding member having a substrate, a magnetic record layer and a top layer characterized in that the top layer is formed by applying a coating liquid containing an organic solvent-dispersing silica and a binder resin, wherein the silica is in the form of particles having a surface area of 10 $m^2/g$ to 1000 $m^2g$.

26. The image holding member as defined in claim 25, wherein the magnetic record layer is a thin film of $CrO_2$.

27. The image holding member as defined in claim 25, wherein the hydrophobic silica is in a form of the powder of a primary particle diameter of 10Å to 1000Å.

28. The image holding member as defined in claim 25, wherein the hydrophobic silica is in a form of the powder of a primary particle diameter of 10Å to 500Å.

29. A display unit, housing an image holding member which is used in repetitions for image display, the image display being effected by forming toner images corresponding to the information in signals directly on the surface of the image holding member wherein the toner-image-forming top layer of the image holding member is formed by applying a coating liquid containing an organic-solvent-dispersing type silica and a resin, wherein the silica is in the form of particles having a surface area of 10 $m^2/g$ to 1000 $m^2/g$.

30. The display unit as defined in claim 29, wherein the toner-image-forming-top layer is a film containing a white pigment and a binder resin.

31. The display unit as defined in claim 30, wherein the white pigment is titanium oxide pigment, zinc oxide pigment or tin oxide pigment.

32. The display unit as defined in claim 29, wherein 1 to 200 parts by weight of the organic-solvent-dispersing-type silica is contained per 100 parts by weight of the resin.

33. The display unit as defined in claim 29, wherein 1 to 150 parts by weight of the organic-solvent-dispersing type silica is contained per 100 parts by weight of the resin.

34. The display unit as defined in claim 29, wherein 10 to 50 parts by weight of the organic-solvent-dispersing type silica is contained per 100 parts by weight of the resin.

* * * * *

UNITED STATES PATENT AND TRADEMARK OFFICE

CERTIFICATE OF CORRECTION

PATENT NO. : 4,647,521

DATED : March 3, 1987

INVENTOR(S) : YOSHIHIRO OGUCHI, ET AL.

It is certified that error appears in the above-identified patent and that said Letters Patent is hereby corrected as shown below:

COLUMN 5

Line 45, "3" should read --5--.

COLUMN 6

Line 36, "26" should read --16--.

COLUMN 20

Line 26, "012," should read --0.12,--.

COLUMN 28

Line 8, "the" should read --The--.
Line 17, "power" should read --powder--.
Line 20, "power" should read --powder--.
Line 30, "of hydrophobic" should read --of the hydrophobic--.
Line 38, "iso-propyl" should read --isopropyl--.
Lines 62-63, "organic-solvent dispersing type" should read --organic-solvent-dispersing-type--.

COLUMN 29

Line 1, "imaging-holding" should read --image holding--.

UNITED STATES PATENT AND TRADEMARK OFFICE

CERTIFICATE OF CORRECTION

PATENT NO. : 4,647,521

DATED : March 3, 1987

INVENTOR(S) : YOSHIHIRO OGUCHI, ET AL.

It is certified that error appears in the above-identified patent and that said Letters Patent is hereby corrected as shown below:

COLUMN 30

Line 1, "organic-solvent-dispersing type" should read --organic-solvent-dispersing-type--.

Lines 15-16, "organic solvent-dispersing type" should read --organic-solvent-dispersing-type--.

Lines 19-20, "organic-solvent-dispersing type" should read --organic-solvent-dispersing-type--.

Signed and Sealed this

Eleventh Day of August, 1987

*Attest:*

DONALD J. QUIGG

*Attesting Officer*

*Commissioner of Patents and Trademarks*